US005678478A

United States Patent [19]

Goyal et al.

[11] Patent Number: 5,678,478

[45] Date of Patent: Oct. 21, 1997

[54] OIL FILTER CRUSHING APPARATUS AND SYSTEM

[75] Inventors: Prakash R. Goyal; Jon W. Kline, both of Mansfield, Ohio

[73] Assignee: Goyal Industries, Inc., Mansfield, Ohio

[21] Appl. No.: 583,783

[22] Filed: Jan. 11, 1996

[51] Int. Cl.[6] ..... B30B 9/04; B30B 15/18

[52] U.S. Cl. ..... 100/52; 100/53; 100/116; 100/131; 100/269.16; 100/902

[58] Field of Search ..... 100/50–53, 116, 100/131, 252, 269.16, 902

[56] References Cited

U.S. PATENT DOCUMENTS 3,104,607 9/1963 Galas ..... 100/902

4,212,240 7/1980 Lee et al. ..... 100/52

5,174,199 12/1992 King et al. ..... 100/902

5,279,215 1/1994 Harder ..... 100/902

5,303,643 4/1994 Fisher et al. ..... 100/51

*Primary Examiner*—Stephen F. Gerrity

*Attorney, Agent, or Firm*—Mueller and Smith, LPA

[57] ABSTRACT

An apparatus for crushing spent oil filters for recovery of spent oil therefrom, which includes a frame which carries an oil filter crushing chamber, and located therebeneath the frame also carries a hydraulic actuation assembly, a vertical hydraulic ram assembly, a latch mechanism, and a safety control circuit.

27 Claims, 7 Drawing Sheets

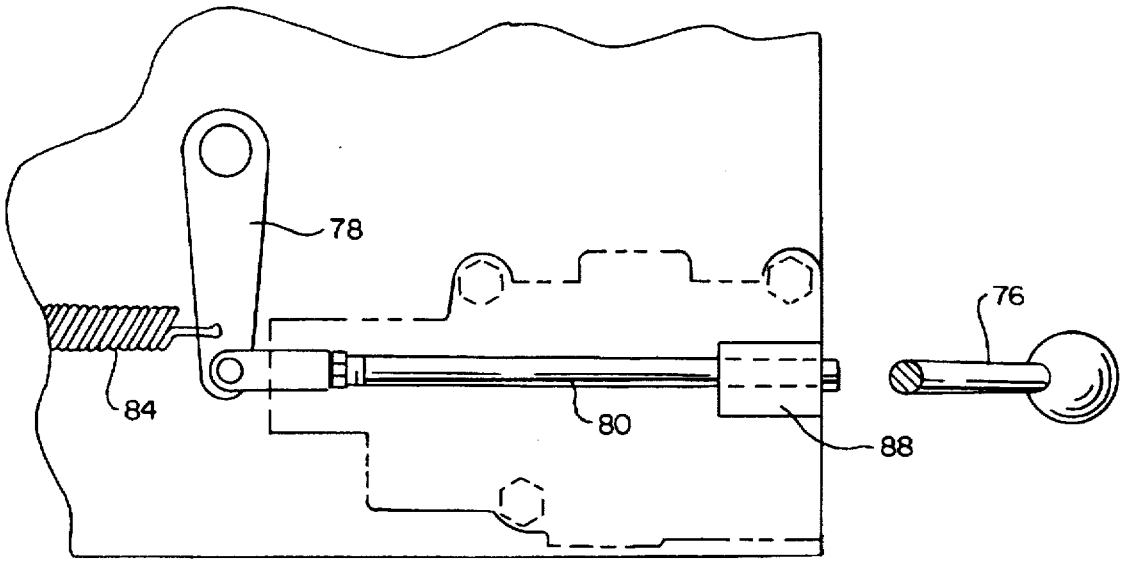
FIG. 7
FIG. 8
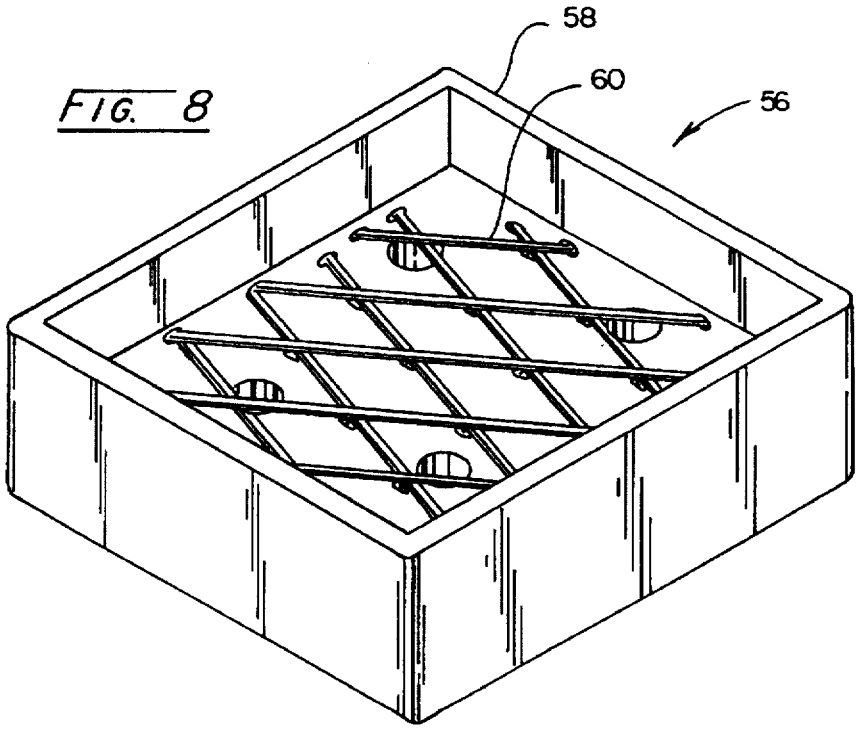

OIL FILTER CRUSHING APPARATUS AND SYSTEM

BACKGROUND OF THE INVENTION

The present invention relates to the disposal of oil filters and more particularly to an environmentally safe and economic apparatus, method, and system therefor.

The U.S. Environmental Protection Agency has promulgated rules declaring that waste oil constitutes a hazardous material. As such, waste oil must be carefully collected, and then either recycled or disposed of in accordance with stringent disposal procedures. Thus, landfill disposal of used oil filters (which contain oil) no longer is an option to the automotive industry nor to the ordinary consumer. Instead, used oil filters must be hauled away by costly toxic waste disposal services which collect and handle toxic materials at considerable expense.

It has been estimated that about one-half of the residual oil in the used oil filters can be recovered simply by draining the oil filter—more exhaustive recovery techniques must be employed in order to recover the balance of the residual oil in the oil filter. Such recovery techniques primarily have focused on crushing of the spent oil filters which not only causes expulsion of the spent oil for recovery, but also results in the compaction of the filter housing which makes it easier to dispose of, e.g., less voluminous, to the extent that about 3–5% residual oil remains in a crushed filter while the crushed filters enable up to 10–12 times more crushed filters to be placed in a 55 gallon drum compared to uncrushed filters. Several proposals aimed at crushing oil filters have been reported.

U.S. Pat. No. 5,257,576 describes an apparatus for crushing used automotive oil filters, and for squeezing out and collecting the dirty oil. The apparatus involves a pneumatic piston which is mounted for vertical travel and is surmounted by a platen housed in a crusher chamber. The oil filter to be crushed is placed on the platen and, as the piston is extended under pressure, is crushed against an upper platen. Although the pneumatic piston is shown to be mounted below the filter being crushed, this patent notes that if a hydraulic piston were used, the platen thereof would have to be located in so flimsy a manner that the platen would easily rock and tip. [col. 4, 11. 36–61].

U.S. Pat. No. 5,125,331 discloses a device for crushing and extracting oil from oil filters which includes a chamber within which a reciprocating plunger is slidably operated. A hydraulic cylinder is horizontally mounted with respect to the chamber to drive the plunger which, in turn, crushes any articles within the chamber against a side wall thereof.

U.S. Pat. No. 5,325,771 discloses an oil filter crusher unit which includes a pneumatic piston connected via a bearingless shaft to a filter crushing head mounted for vertical travel above the filter.

U.S. Pat. No. 5,297,479 discloses an oil filer crusher which includes a horizontal platform with vertical support members projecting upwardly therefrom through a base plate. The support members are connected to the piston of a pneumatic cylinder which is positioned over the platform. The platform is movable vertically upwards toward the base plate in response to the actuation of the cylinder to crush the oil filter therebetween.

U.S. Pat. No. 5,109,763 discloses an oil filter crushing apparatus which includes a chamber within which a reciprocating plunger is slidably operated. A hydraulic cylinder is horizontally mounted with respect to the chamber to drive the plunger which, in turn, crushes any articles within the chamber against a side wall thereof.

U.S. Pat. No. 4,927,085 discloses an oil filter crusher having an upright compartment which receives the filter. A crusher plate is mounted above the filter and is guided for vertical sliding movement within the compartment by a hydraulic jack. Downward movement of the crusher plate collapses the oil filter.

U.S. Pat. No. 4,467,715 discloses a press for moist, fibrous waste having a pair of spaced-apart grates which are moved relative to each other by a horizontally-mounted ram.

U.S. Pat. No. 4,213,386 discloses a doubling-acting compacting apparatus having two movable compaction plates and a stationary plate positioned therebetween. The movable plates are driven with by the stroke of a horizontally-mounted cylinder.

Despite these proposals, there still exists a need in the art for an oil filter crushing apparatus with improved safety features and which is compact, yet which efficiently and efficaciously crushes the spent filters for recovery of spent oil therefrom.

SUMMARY OF THE INVENTION

Broadly, the present invention is directed to an apparatus for crushing spent oil filters for recovery of spent oil therefrom. Such apparatus includes a frame which carries an oil filter crushing chamber, and located therebeneath said frame also carries a hydraulic actuation assembly, a vertical hydraulic ram assembly, a latch mechanism, and a safety control circuit. The hydraulic actuation assembly is connected to the vertical hydraulic ram assembly for selectively actuating the ram assembly from a lower station within said chamber to an upper position at an upper station within the chamber and then returning to the lower station. Preferably, a two-stage pump is used to pressurize the hydraulic fluid. The vertical ram assembly is fitted with an oil filter receiving ram plate upon which is fitted an annular collar which defines an oil filter receiving station. The ram plate contains outlets for draining oil from the crushed oil filter to a spent oil receiving station. The upper surface of the ram plate bears a mesh element upon which the oil filter to be crushed is placed and which prevents pressure from being built up in the oil filter during its crushing. The chamber is fitted with a door which provides access to within the chamber so that a spent oil filter can be placed onto said oil filter receiving station.

The latch mechanism includes a latch plate that locks the chamber door in a closed position when the hydraulic ram assembly actuates a striker attached to the latch plate. The striker adapted to be moved by the ram plate when it returns to the lower station to rotate said latch plate to unlock the chamber door. The latch mechanism also includes a pivot arm connected to said latch plate; a hand-manipulable handle pivotally connected to the pivot arm; a hydraulic valve connected to both the pivot arm and the handle for actuation by either; and a biasing member that biases the hydraulic valve into a neutral position and biases the latch plate in a chamber door locking position. The latch mechanism operates by the handle being manipulable to cycle the ram assembly by moving the hydraulic valve to an upward position to cause the ram plate to move upwards and out of contact with the striker which causes the latch plate to lock the chamber door. When the oil filter crushing is complete the valve switches to a downward position so that the ram plate is moved downward until it contacts the striker which rotates the latch plate to unlock the chamber door and to return the hydraulic valve to its neutral position. Finally, the safety control circuit is effective to inactivate the ram plate upon the opening of the chamber door when the ram plate is not at its lower station and when the hydraulic pressure in the hydraulic actuation assembly being above a desired set value.

As another aspect of the present invention, a safety control circuit is disclosed to include a connector switch having an inductor and at least one normally open motor drive contact coupled for energizing said motor. The inductor is energizable from said source and is located within a network coupled in electrically parallel relationship with the motor. A normally open start switch is actuable from an open to a closed condition to effect application of said source to energize the inductor so as to effect closure of said motor to effect commencement of movement of said ram. A ram monitor switch having first and second contact components is connected in mutually parallel relationship and in series relationship with the inductor and actuable to open and close the first and second contact components. A ram switch actuator is movable in correspondence with the ram and effects actuation of the ram monitor switch to close the first contact component and open the second contact when the ram interval is at the initial position, and actuates the ram monitor switch to open the first contact component and close the second contact component when said ram is moved from its initial station;. A door switch is coupled in energization enabling relationship with an inductor and has an enabling condition when the access door is in its closed orientation permitting energization of the inductor and a disabling condition when the access door is in its open orientation disabling the energization of the inductor.

Advantages of the present invention include a vertical orientation ram drive which locates all of the major components beneath the crushing chamber and within the footprint of a frame for safety. Another advantage is the use of a two-stage hydraulic pump for minimizing crushing cycle times. A further advantage is the use of unique valve and linkage arrangement for controlling the crushing cycle and an access door interlock for safety. Yet another advantage is the use of a shared plate between the crushing chamber and the piston assembly with a double sealing system. Yet a further advantage is a unibody crushing chamber design. These and other advantages will be readily apparent based on the disclosure herein contained.

BRIEF DESCRIPTION OF THE DRAWINGS

FIG. 7 is an alternative arrangement for the valve control mechanism shown at FIG. 5;

FIG. 8 is a perspective view of the apertured ram plate of the vertical ram assembly;

The drawings will be described in detail below.

DETAILED DESCRIPTION OF THE INVENTION

Figure 1:
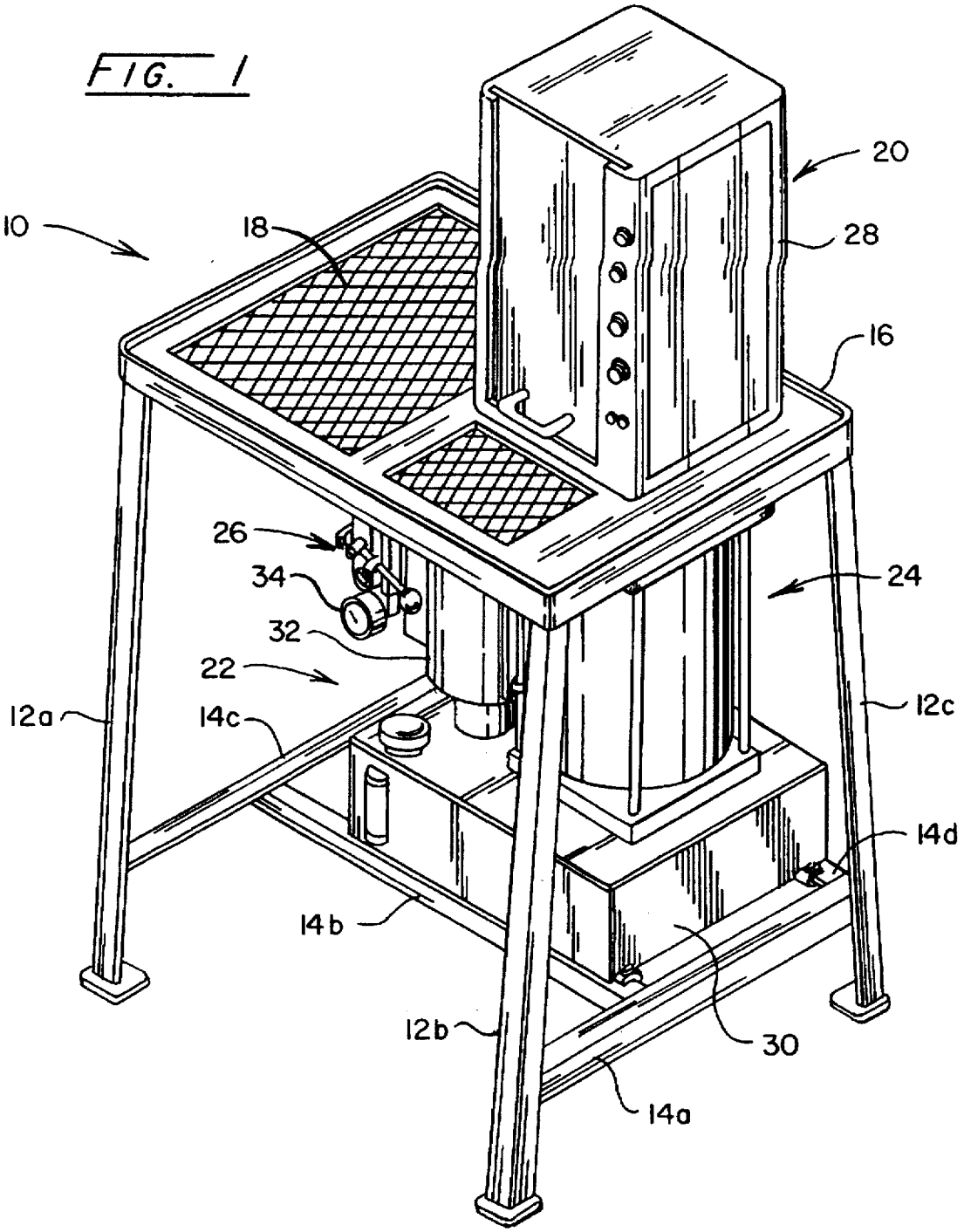
FIG. 1 is a perspective view of the novel oil filter crushing apparatus of the present invention.

The present invention is unique in several aspects of the inventive oil filter crushing apparatus, including the use of a two-stage pump, the valve and linkage, the switch system, the seals and shared ram plate, and the overall system and method employed therein. In this regard, reference initially is made to FIG. 1. Frame 10 is seen to be composed of legs 12*a*–12*d* (see FIG. 2) with lower bracing members 14*a*–14*d*. Upper table member 16 is seen to have wire mesh 18 which permits any oil leaking from the oil filters to drain through table 16 for collection via hose 17 (see FIG. 3). Additionally, table 16 has an upstanding lip or apron for preventing any oil spills from running off of the table and spilling onto the floor. While frame 10 is seen to be of simple structural steel construction, it will be appreciated that the frame can be mobile or permanently mounted, and manufactured from a wide variety of materials and configurations as is necessary, desirable, or convenient.

Oil filter crushing chamber 20 will be seen to be mounted atop table 16. All of the other components of the spent oil filter crushing apparatus are disposed beneath crushing chamber 20 and within the footprint of frame 10. This configuration lowers the center of gravity of the unit which makes it more stable, as well as places the remaining active components within frame 10 for their protection. Besides filter crushing chamber 20, frame 10 additionally carries hydraulic actuation assembly generally identified at 22, vertical hydraulic ram assembly 24, latch mechanism 26, safety control circuit identified at 28, and an oil receiving station (not shown). Hydraulic actuation assembly 22 generally is composed of reservoir 30 for the hydraulic fluid, motor 32, pressure gauge 34, and a valve which is part of the latch mechanism to be described in detail below. Hoses are provided conventionally and will not be described in detail herein.

Figure 3:
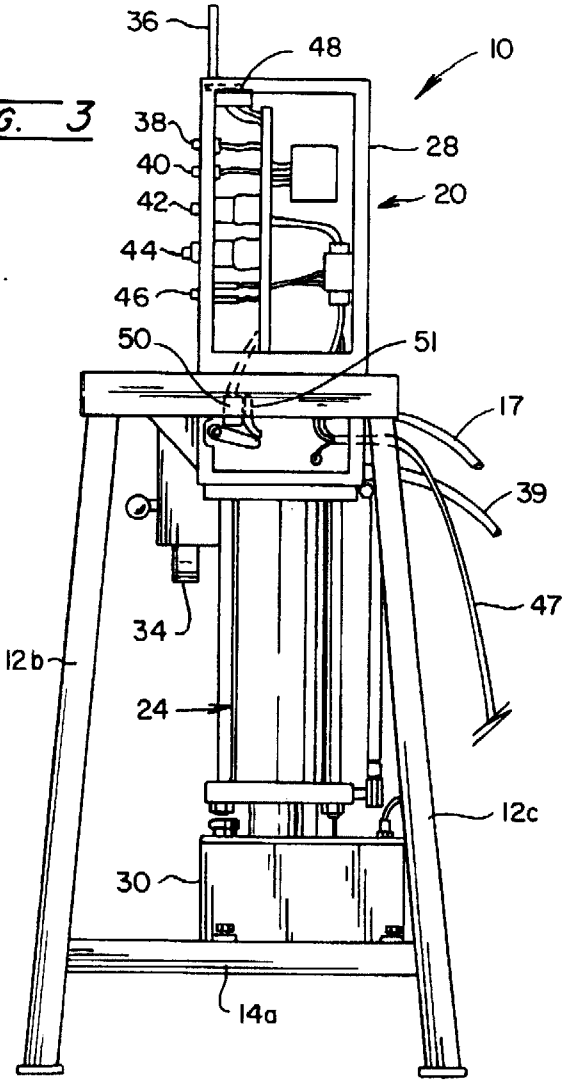
FIG. 3 is side elevational view of the apparatus with the access door to the safety control circuit being removed.
Figure 2:
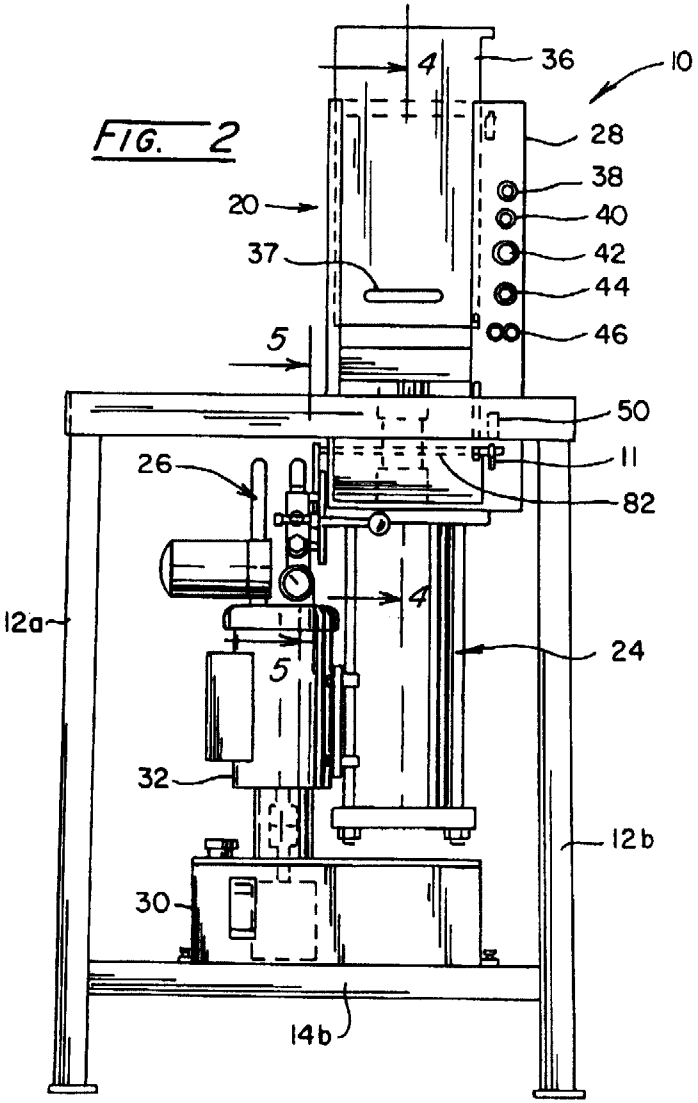
FIG. 2 is a front elevational view of the apparatus.

Referring now to FIGS. 2 and 3, it will be observed that access door 36 is slidably mounted onto chamber 20 and can be moved conveniently via handle 37. Two spring loaded balls (not illustrated in the drawings) are installed behind the access door, at the top of crushing chamber 20 to permit the access door to be held in an infinite number of positions with minimal effort and to let the balls engage into a detent at the top of the access door panel at the fully open position until a manually operate pin is inserted in the track to prevent access door 36 from falling down. Housed within chamber 20 also is safety control circuit 28 which similarly is covered by a removable access door (not shown at FIG. 3). Revealed at FIG. 3 are the electronic components which form a part of safety control circuit 28 and which will be described in detail below. It will be observed that electrical connections are made to green light 38, red light 40, on switch 42, off switch 44, and a pair of circuit breakers 46 which provide the status of the crushing apparatus to the operator. These too will be described in further detail below. Power comes from electrical cord 47. It will be further observed that electrical connection also is made to sensor or microswitch 48 and microswitch or sensor 50. Microswitch 48 senses whether access door 36 is in a down and closed position so that the crushing apparatus can be activated. If the sensor does not determine that the access door is down, even during actuation of the machine, the safety control circuit will cause the machine to be turned off. Similarly, microswitch 50 provides the status of the latch mechanism, specifically as to whether locking latch plate 52 (see FIGS. 2 and 4) has been rotated to lock access door 36 into a down positioned sealing the interior of chamber 20 from the user. Again, when latch plate 52 is not in a locking position, the novel crushing apparatus again will cease to function due to the safety control circuit's capabilities which will be described in detail below.

Figure 4:
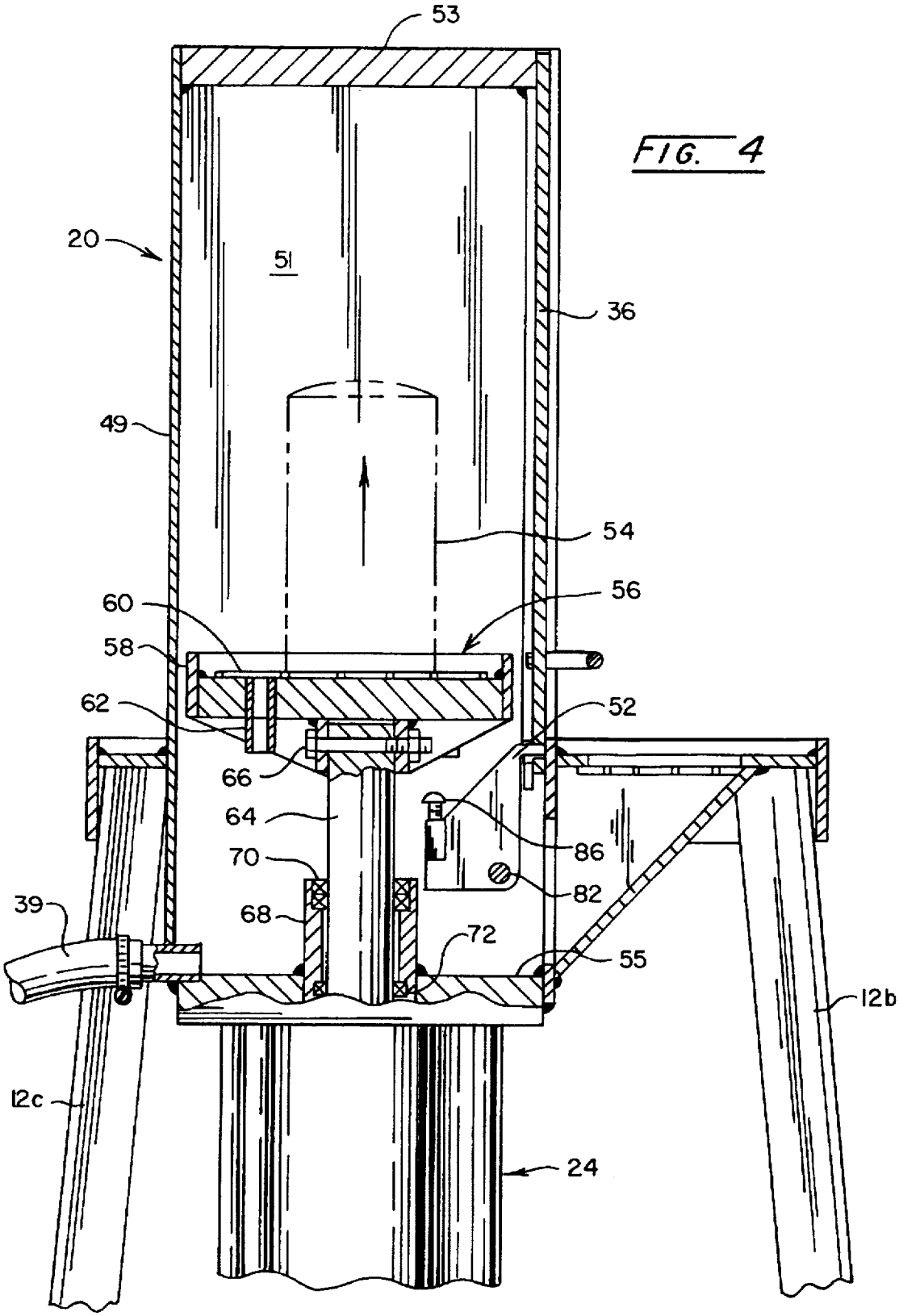
FIG. 4 is a sectional view of FIG. 2 taken along line 4—4.

Referring to FIG. 4, chamber 20 is seen in cross-section taken along line 44 of FIG. 2. Oil filter 54 to be crushed is seen in phantom disposed within the interior of crushing chamber 20. Oil filter 54 sits atop ram plate 56 which is shown in enlarged perspective at FIG. 8. Sidewalls 58 provide strength to ram plate 56 with minimal extra weight and provide a dam or weir function to contain oil emitted from oil filter 54 and to ensure that filter 54 stays located atop ram plate 56 even during the crushing operation. Mesh element 60 sits atop plate 56 and ensures that the bottom of filter 54 is spaced apart from ram plate 56. This means that any pressure being built up within the oil filter during its crushing will not cause the oil filter to explode. It must be borne in mind that the oil filter is placed with its aperture on plate 56. Such aperture contains a seal for preventing leakage of oil when the oil filter is installed in an engine. Mesh element 60 prevents that seal from sealing oil filter 54 to plate 56. Apertures in plate 60, typified by aperture 62 (FIG. 4) drain oil expelled from oil filter 54 for collection via a drain system through hose 37 which typically is in fluid communication with a 55 gallon drum or like container or reservoir which collects the oil and which can be easily replaced with an empty drum when a prior drum becomes full (drum not shown). It will be appreciated that ram assembly 24 is vertically mounted and crushes the oil filter by an upward stroke of piston 64 which is actuated by hydraulic actuation assembly 22. Piston 54 is connected to ram plate 56 via bolt and washer assembly 66. Hydraulic actuation assembly 24 is sealed from chamber 20 by collar 68 which is fitted with a pair of upper O-ring seals 70 and lower O-ring assembly 72. Such double sealing system ensures that liquid and particulates will not contaminate hydraulic actuation assembly 22 via the opening created for hydraulic piston 64 and that hydraulic fluid will not leak from the hydraulic system. Collar 68 also provides a damming function in that expelled oil will be confined by collar 68 and denied contact with piston 64, thus ensuring that dirty oil will not contaminate piston 64. It will be observed that mesh element 60 and sidewalls 58 form an oil filter receiving station wherein oil filter 54 can be placed for its crushing.

Unique in the design of chamber 20 is its unibody construction and the use of a shared plate between it and piston assembly 24. From FIG. 4, it will be observed that the chamber walls (e.g., walls 49 and 51 ) are integral with top wall 53 and bottom wall 55 (e.g., by being welded together). Bottom wall 55 also is the top plate for piston assembly 24 while chamber top wall 53 defines the stroke end of piston assembly 24. Thus, chamber 20 and piston assembly 24 share bottom plate 55, which makes these assemblies effectively a single unit. Frame 20, then, merely holds this unit off of the ground. It should be noted that oil expelled from oil filter 54 collects on bottom shared wall 55 for removal through drain hose 39. Also, some oil may spill out of containment by walls 58, but this spillage will provide lubrication between the chamber walls and ram plate 56.

Figure 5:
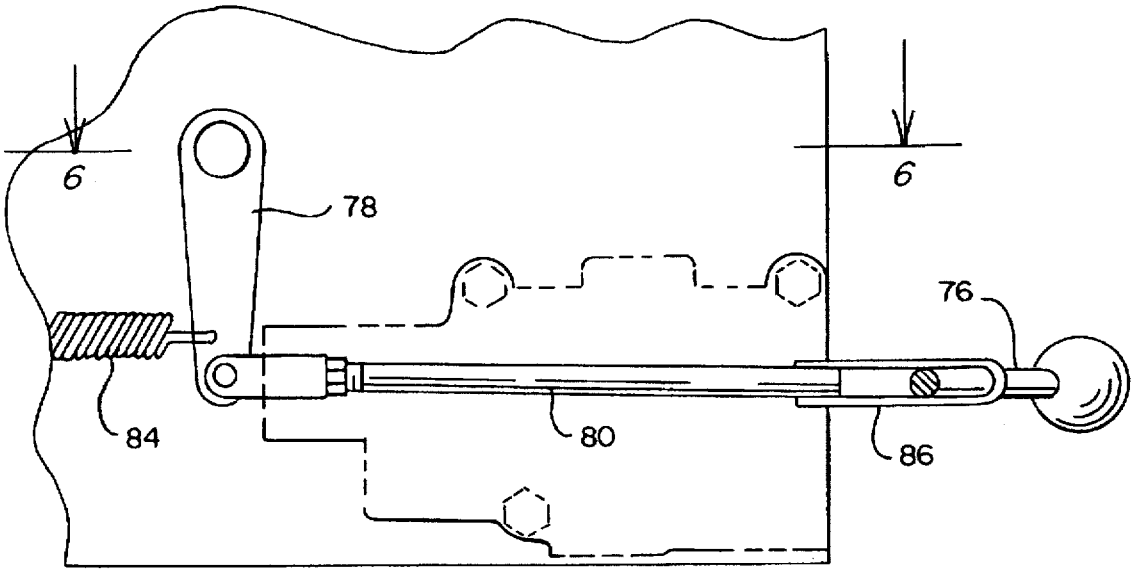
FIG. 5 is a sectional view of FIG. 2 taken along line 5—5.
Figure 6:
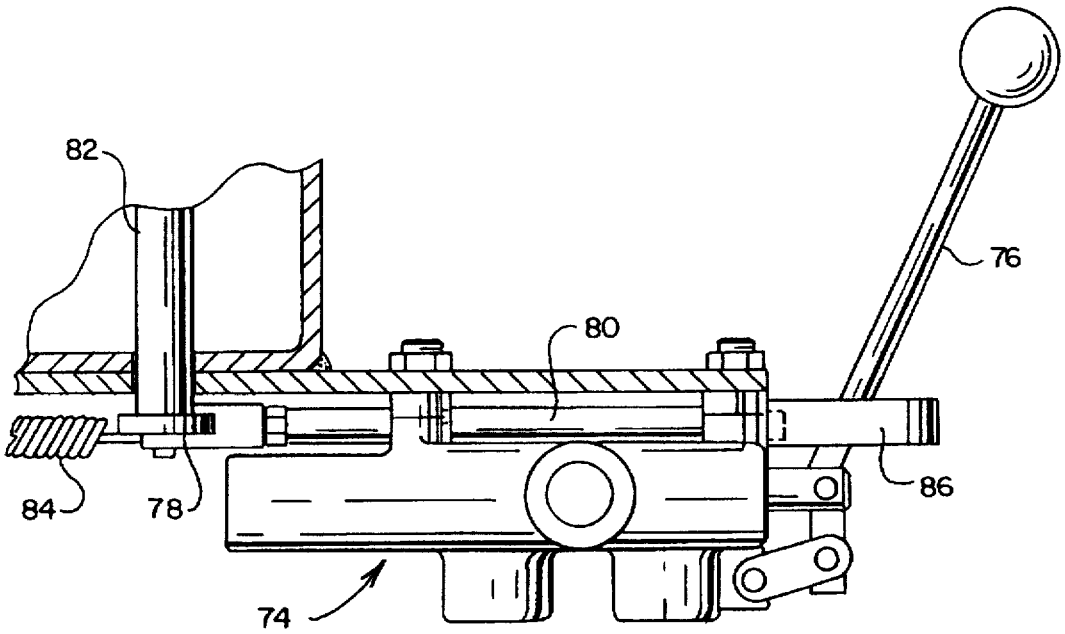
FIG. 6 is a sectional view of FIG. 5 taken along line 6—6.

Referring to FIG. 5, which is a sectional view of latch mechanism 26 taken along line 5—5 of FIG. 2 and FIG. 6 which is a sectional view taken along line 6—6 of FIG. 5, valve 74 (LS 300-1, 3-position, 4-way control valve, Prince Manufacturing Company, modified to operate as described herein) is seen to be connected by handle assembly 76 at one end and to cam assembly 78 at the other end via rod 80. Handle assembly 76 permits rod 80 to be pushed in to activate a crushing cycle, but guard 86 denies the user access to rod 80 to pull it out to unlock access door 36 while the crushing cycle is in operation, as a safety feature. Collar 88 (FIG. 7) is an alternative arrangement to deny the user access to rod 80.

Returning to FIG. 5, cam assembly 78 is connected via pivot arm 82 to pivot plate 52 (see FIG. 4). Biasing member or spring 84 is connected to cam assembly 78 and biases hydraulic valve 74 into a neutral position and biases latch plate 52 into a access door locking position, that is, a position where chamber access door 36 is locked in a down position sealing chamber 20 from the outside. Striker 86 (see FIG. 4) is attached to locking latch plate 52 and when struck by the bottom of ram plate 56, causes latch plate 52 to rotate to a position where it does not lock or engage access door 36. Pivot arm 82 terminates at the other end with cam 11 which activates microswitch 50 by pushing against lever 51 of switch 50. The operation of the valve 74 will be described in detail below.

As to a crushing cycle, oil filter 54 is put into crushing chamber 20 and access door 36 shut. Handle assembly 76 is pulled out into a detent or maintained positioned. This position of the valve allows the hydraulic oil to flow to the bottom end of hydraulic cylinder assembly 24 moving ram plate 56 upward. Crushing begins when the top of filter 54 comes into contact with top plate 53 of chamber 20. The hydraulic pump operating in its first stage of high volume and low pressure extends ram plate 56 rapidly until the increasing crushing pressure requires the pump to operate in its high pressure low volume mode. The return stroke again occurs in the high volume low pressure mode. This combination of volume and pressure renders a superior efficiency to the crushing cycle, reducing the overall crushing cycle time. As the crushing pressure reaches a preset value registered by a pressure switch, the hydraulic valve actuates to its return position. The hydraulic oil flow reverses from the bottom of cylinder assembly 24 to the top and retracting ram plate 56. Descending ram plate 56 then hits striker 86 of latch plate 52, unlatching access door 36 for the next loading and rotating lynch pin 78 which causes rod 80 to put the valve back into its neutral position. Cam 11 operates microswitch 50 allowing the green light to come on.

Figure 9:
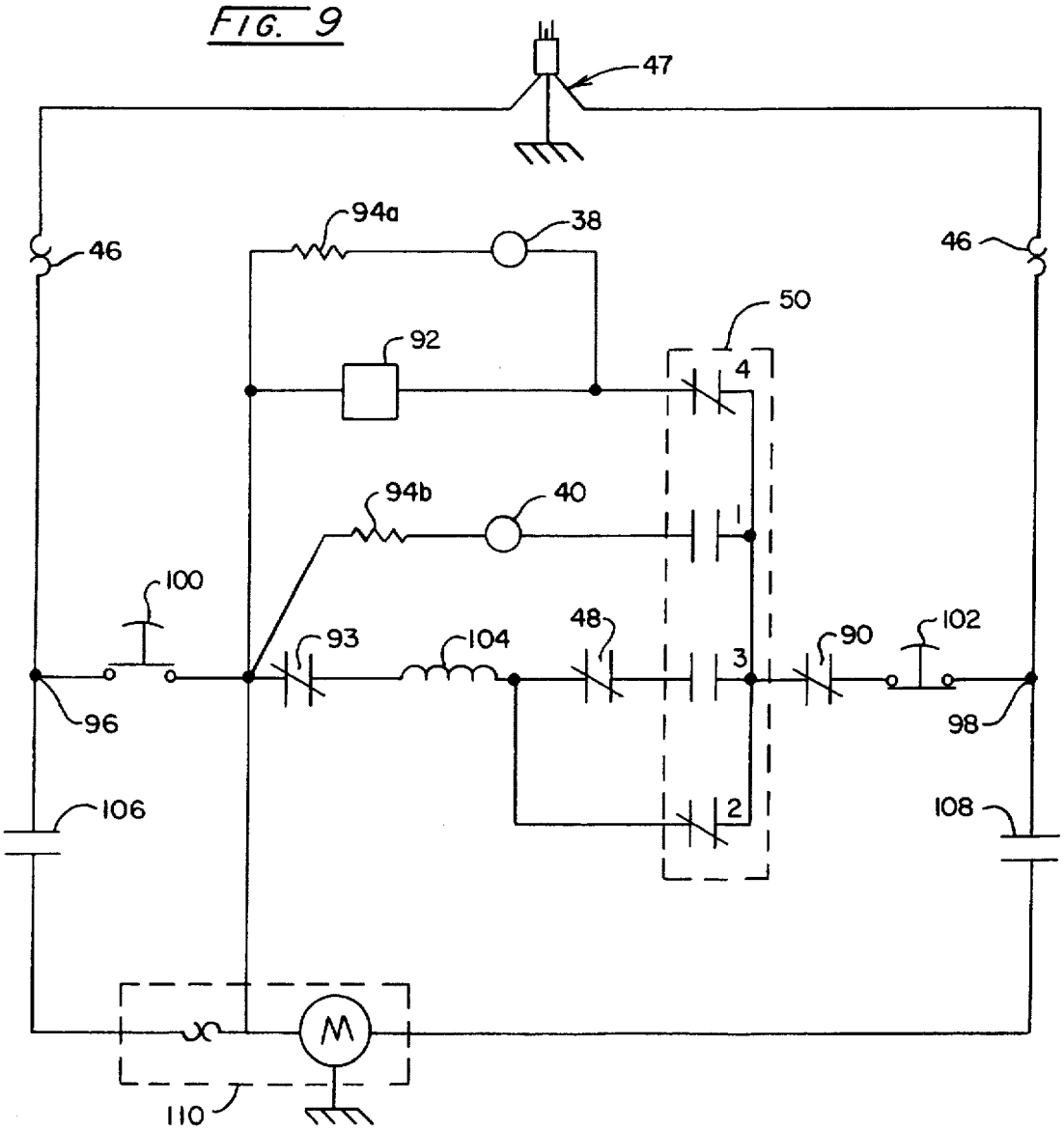
FIG. 9 is an electrical schematic of the electrical control assembly.

With respect to safety control circuit 28, reference is made to the electrical schematic depicted at FIG. 9. Hydraulic system thermal protection is provided by hydraulic thermostat 90 (type 33M+063H, Portage Electrical Products, Inc., rated at 250 vac, 3 amp., single pole normally closed contacts) which is provided with normally closed contacts. Thermostat 90 senses hydraulic oil temperature in reservoir 30 and shuts off the machine when the oil temperature exceeds a set point. The machine cannot be restarted until the oil temperature cools below the set point. An automatic shut-off system is provided by timer 92 (thermal type comprised of a 5 watt resistor, 7.5 k ohms and type 51L+094F thermostat, Portage Electrical Products, Inc. rated at 250 vac, 3 amp, single pole normally closed contacts) normally closed contact 93. In the event the operator leaves the machine unattended, timer 92 will time for, say 3–5 minutes, and then open its normally closed contacts, thus shutting off the machine. Green status light 38 indicates a cycle has completed and/or is ready to cycle again while red light 40 indicates that a cycle is in progress. Dropping resistor 94 reduces the voltage to the proper level for status lights 38 and 40.

The inventive apparatus also is equipped with two safety interlocks, sensors or microswitches 48 (Unimax brand, unsealed microswitch, momentary action single pole, double throw type, rated at 15 A, 125/250 vac.) and 50 (Unimax brand, unsealed microswitch, momentary action double pole, double throw type with sequential make and break of contact poles rated at 15 A, 125/250 vac.), which are interconnected. The purpose of these interlocks is to shut off the machine when the access door is opened during the performance of a cycle. Also, these interlocks or sensors allow the access door to be opened at the end of a cycle without shutting off the machine. Additionally, contacts 1 and 4 of microswitch 50 allow the operation of status lights 38 and 40, and timer 92 at proper times. Timer 92 is reset (shut off by sensor contact 4) at the beginning of each cycle. The actuation of interlocks 48 and 50 is by the position and movement of ram plate 56 acting on microswitch 50 and access door 36 acting on sensor 48. The positions of all switches and other electrical elements in the electrical schematic depicted at FIG. 9 represents the conditions of ram plate 56 in the down position and the access door down or shut. Contact 2 of microswitch 50 is closed, creating an additional path around microswitch 48. This allows the access door to be opened (the change of microswitch 48 contact has no effect on the contact or coil activation. Contact 4 of microswitch 50 allows the activation of green light 38 and timer 92. When a cycle is commenced, the movement of ram 56 changes the condition of microswitch 50 contacts, closing contacts 1 and 3 and opening contacts 2 and 4. In this condition, if access door 36 is opened, the machine will shut off. Also, red light 40 is activated, and green light 38 and timer 92 are shut off.

Ram microswitch 50 displayed at FIG. 9 has unique switching capability. The switch is made up of two single pole double-throw switches. An activation lever sequentially operates contacts 1, 2, 3, and 4, in such a manner that only one of the pair of contacts 1 and 2, or 3 and 4, may remain activated at any one time, and the switching of contacts is such that at no time does the 96–98 control circuit remain open. The depression of the lever switches the status of contacts 1 and 2 (normally closed to open and normally open to closed). Continuing the depression of the level will change the status of contacts 3 and 4. The releasing of the lever changes the status of the contacts in reverse order (4, 3 and 2,1). Completing the electrical schematic are, on switch 100 (Baco brand, green, momentary action push button operator with detachable contact block, single pole, normally open contact guype MIXB1 & V11AABO2 operator, contact rated at 600 V, 10 amp.), off switch 102 (Baco brand, red, momentary action push button operator with detachable contact block, single pole, normally closed contact type MIAX1 & V11ABO1 operator, contact rated at 600 V, 10 amp.), two-pole, normally-open contactor or vacuum coils or indicator 104 (Furnas brand, 2 pole, normally open type 45EG20AG rated at 190–220 V at 40 Hz and 208–240 V at 60 hz, 30 full load amp and 180 locked rotor amp at 277 vac, 240 vac coil, open frame), normally open contacts 106, and 108, and unit 110 (Century Electric/Magnetek brand, 5 hp. with thermal overload manual reset type B386 rated at 240–208 vac, 22 amp at full load, Y56HZ frame, drip-proof rigid base, single phase, 3600 rpm) which represents the motor of the hydraulic system with thermal overload and manual reset.

While conventional switches can be used to switch contacts 1 and 2, or 3 and 4, the control circuit then containing the latch coil would become open for a fraction of a second during switching, dropping out the latch coil and shutting off the machine. This sequential switching of contacts as described also eliminates the possibility of moving up the ram plate by holding the on switch down which is not only unsafe, but also could burn up the contactor.

Figure 10:
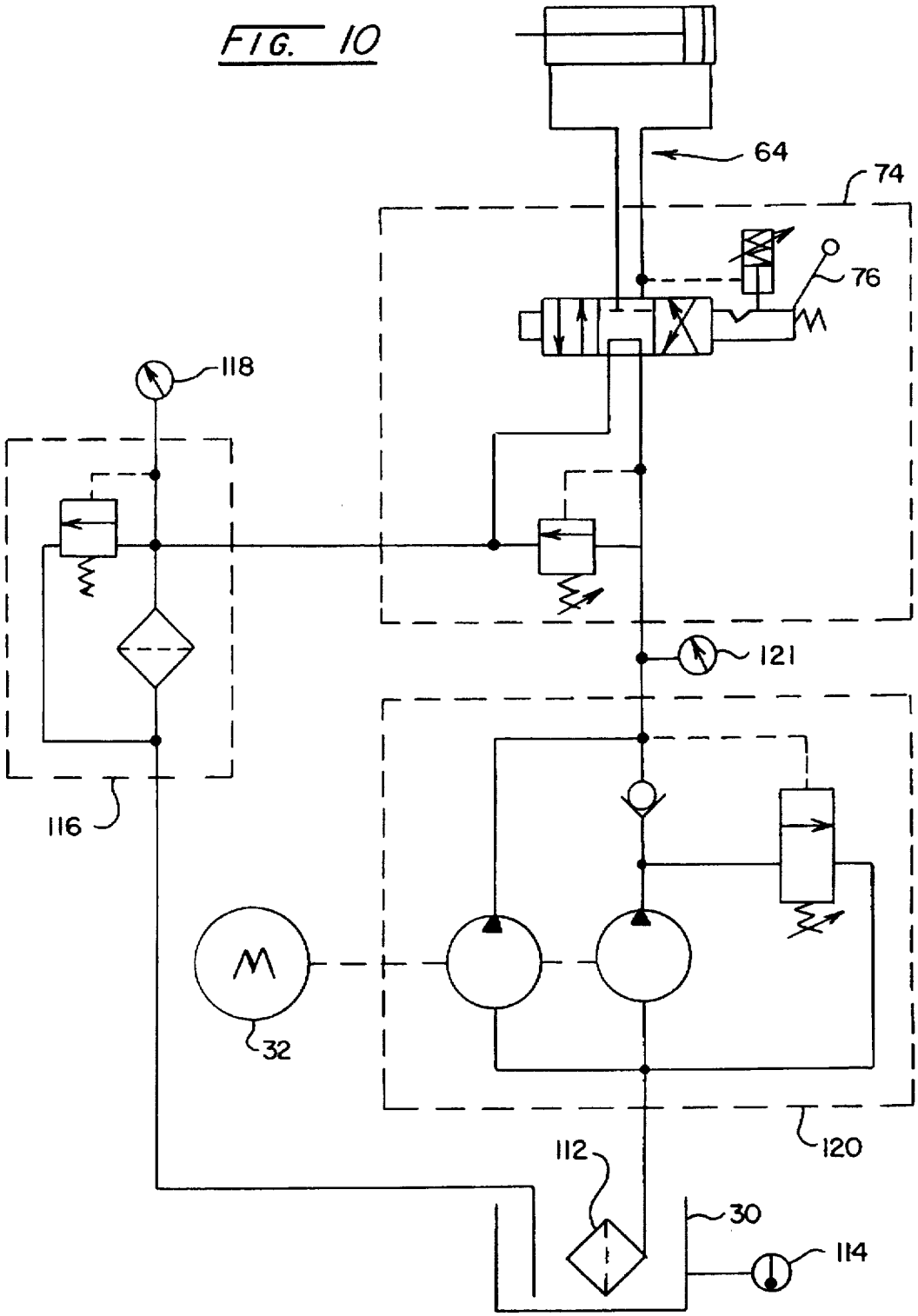
FIG. 10 is a hydraulic schematic of the hydraulic actuation assembly.

Referring to the hydraulic schematic depicted at FIG. 10, hydraulic valve 74 is a three-position, four-way valve with integral relief valve. Once initiated, it sequences through all three positions. Valve 74 will extend piston 64 until a preset adjustable pressure is reached, then reverse the fluid direction to retract piston 64. When piston 64 is retracted, ram plate 56 contacts striker 86 which returns the valve spool back to the neutral or start position. Valve 74 is made up of a spool assembly and spring, a relief valve assembly, a pressure operated detent release piston assembly and spring, a body, and seals necessary for drip-proof operation. The major components are hydraulic fluid tank 30 with intake strainer 112 and fluid site and temperature indicator 114. Fluid filter 116 with integral bypass is fitted with fluid filter gauge 118. Motor 32 is associated with two-stage pump 120 with integral pressure sensitive control. System pressure gage 121 is provided between pump 120 and valve 74. Valve 74 which actuates piston 64 completes the hydraulic circuit.

We claim:

1. An industrial apparatus for crushing spent oil filters for recovery of spent oil therefrom which comprises:

(a) a frame which carries an oil filter crushing chamber, and located therebeneath said frame also carries a hydraulic actuation assembly, a vertical hydraulic ram assembly, a latch mechanism, and a safety control circuit;

(b) said hydraulic actuation assembly connected to said vertical hydraulic ram assembly for selectively actuating said ram assembly from a lower station within said chamber to an upper position at an upper station within said chamber and then returning to said lower station;

(c) said vertical ram assembly fitted with an oil filter receiving ram plate upon which is fitted an annular collar which defines an oil filter receiving station, said ram plate containing outlets for draining oil from said crushed oil filter to a spent oil receiving station, the upper surface of said ram plate beating a mesh element upon which said oil filter to be crushed is placed and which prevents pressure from being built up in the oil filter during its crushing;

(d) said chamber fitted with an access door which provides access to within said chamber so that a spent oil filter can be placed onto said oil filter receiving station, (e) said latch mechanism including:

(1) a rotatable latch plate that locks the chamber access door in a closed position when the hydraulic ram assembly is actuated and a striker attached to the latch plate, said striker adapted to be moved by the ram plate when it returns to the lower station to rotate said latch plate to unlock said chamber access door;

(2) a pivot arm connected to said latch plate;

(3) a hand-manipulable handle pivotally connected to said pivot arm;

(4) a hydraulic valve connected to both said pivot arm and said handle for actuation by either to an upward position or to a downward position;

(5) a biasing member that biases said hydraulic valve into a neutral position and biases said latch plate in a chamber access door locking position, whereby said handle is manipulable to cycle said ram assembly by moving said hydraulic valve to an upward position to cause said ram plate to move upwards and out of contact with said striker which causes said latch plate to lock said chamber access door, and when said oil filter crushing is complete said valve switching to a downward position so that said ram plate is moved downward until it contacts said striker which rotates said latch plate to unlock said chamber access door and to return said hydraulic valve to its neutral position; and (f) said safety control circuit for inactivating said ram plate upon the opening of the chamber access door when said ram plate is not at its lower station and upon the hydraulic pressure in said hydraulic actuation assembly being above a desired set value.

2. The industrial apparatus of claim 1, wherein said pivot arm is connected to switch that is connected to said safety control circuit which is capable of turning off said apparatus when the chamber door is open and said ram is crushing a spent oil filter.

3. The industrial apparatus of claim 1, wherein said valve contains a pressure switch that effects a reversal of flow of hydraulic fluid through said valve and to said ram to reverse the direction of movement of said ram when said pressure switch senses a hydraulic pressure above a pre-set value.

4. The industrial apparatus of claim 1, wherein said crushing chamber has three side walls, a top wall to define an interior cavity, and said moveable access door to access said interior cavity, and said vertical ram assembly comprises a cylinder and rod assembly wherein said cylinder has an apertured plate from which said rod extends, said rod fitted with said oil filter receiving ram plate upon which a spent off filter can be placed for its crushing, said cylinder apertured plate defining a bottom wall of said crushing chamber.

5. The industrial apparatus of claim 4, wherein said crushing chamber three side walls, top wall, and said apertured plate are joined into a unibody structure.

6. The industrial apparatus of claim 5, wherein said walls and plate are welded together.

7. The industrial apparatus of claim 4, wherein the aperture on the chamber side of said apertured plate has an annual collar therearound and through which said rod extends.

8. The industrial apparatus of claim 4, wherein one of said side walls contains an aperture connected to a hose for conveying spent oil from said chamber to an oil receiving station.

9. The industrial apparatus of claim 1, wherein said chamber is fitted with an access door switch that is connected to said safety control circuit which is capable of turning off said apparatus when the chamber door is open and said ram plate is crushing a spent oil filter.

10. The industrial crushing apparatus of claim 1, having a motor energizable from an electrical source to activate the hydraulic actuation assembly to effect the reciprocal drive of said ram assembly, wherein (g) said safety control circuit comprises:

(1) an electrical connector switch having an inductor and at least one normally open motor drive contact coupled for electrically energizing said motor, said inductor being electrically energizable from said source and located within an electrical network coupled in electrically parallel relationship with said motor;

(2) a normally open start switch actuable from an open to a closed condition to effect application of said source to energize said inductor so as to effect closure of said motor to effect commencement of movement of said ram assembly;

(3) a ram monitor switch having first and second contact components connected in mutually parallel relationship and in series relationship with said inductor and actuable to open and close said first and second contact components;

(4) a ram switch actuator movable in correspondence with said ram and effecting actuation of said ram monitor switch to close said first contact component and open said second contact when said ram plate is at said initial station, and actuating said ram monitor switch to open said first contact component and close said second contact component when said ram plate is moved from said initial station; and (5) an access door switch coupled in energization enabling relationship with an inductor and having an enabling condition when said access door is in said closed orientation permitting energization of said inductor and a disabling condition when said access door is in said open orientation disabling the energization of said inductor.

11. The industrial apparatus of claim 10, wherein said safety control circuit additional includes:

a timer deriving a timed output a predetermined safety interval following its energization;

a timing switch coupled with said inductor, normally enabling the energization of said inductor and responsive to said timed output to effect the de-energization of said inductor;

said ram monitor switch includes a third contact component actuable between disabling and enabling conditions respectively to energize and de-energize said timer; and said ram switch actuator effects actuation of said ram monitor switch third contact component to said enabling condition when said ram is at said initial position.

12. The industrial apparatus of claim 11, in which said timer is energizable from said source only in the presence of said closure of said motor drive contact.

13. The industrial apparatus of claim 12, in which said ram switch actuator effects actuation of said ram monitor switch third contact component to said disabling condition when said ram plate is away from the initial position.

14. The industrial apparatus of claim 1, wherein said hydraulic actuation assembly includes a two-stage pump that provides a high volume/low pressure stage and a low volume/high pressure stage.

15. A latch mechanism for locking a chamber access door of an industrial apparatus for crushing spent oil filters, which apparatus includes a hydraulic ram assembly disposed in a chamber, comprising:

(1) a rotatable latch plate that locks the chamber access door in a closed position when the hydraulic ram assembly is actuated from a lower station to an upper station within said chamber and a striker attached to the latch plate, said striker adapted to be moved by the ram plate when it returns to the lower station to rotate said latch plate to unlock said chamber access door;

(2) a pivot arm connected to said latch plate;

(3) a hand-manipulable handle pivotally connected to said pivot arm;

(4) a hydraulic valve connected to both said pivot arm and said handle for actuation by either to an upward position or to a downward position;

(5) a biasing member that biases said hydraulic valve into a neutral position and biases said latch plate in a chamber access door locking position, whereby said handle is manipulable to cycle said ram assembly by moving said hydraulic valve to an upward position to cause said ram plate to move upwards and out of contact with said striker which causes said latch plate to lock said chamber access door, and when said oil filter crushing is complete said valve switching to a downward position so that said ram plate is moved downward until it contacts said striker which rotates said latch plate to unlock said chamber access door and to return said hydraulic valve to its neutral position.

16. The latch mechanism of claim 15, wherein said pivot arm is connected to switch that is connected to said safety control circuit which is capable of turning off said apparatus when the chamber door is open and said ram is crushing a spent oil filter.

17. The latch mechanism of claim 15, wherein said valve contains a pressure switch that effects a reversal of flow of hydraulic fluid through said valve and to said ram assembly to reverse the direction of movement of said ram plate when said pressure switch senses a hydraulic pressure above a pre-set value.

18. In an industrial apparatus for crushing spent oil filters and having a crushing mode and a stand-by mode, which apparatus includes a vertical hydraulic ram assembly which includes a ram plate, a chamber with a moveable access door, and a latch mechanism for locking said chamber access door in a closed position when said apparatus is in its crushing mode, the improvement which comprises:

(a) said crushing chamber having three side walls, a top wall to define an interior cavity, and said moveable access door to access said interior cavity, and (b) said vertical ram assembly comprising a cylinder and rod assembly wherein said cylinder has an apertured plate from which said rod extends, said rod fitted with said oil filter receiving ram plate upon which a spent oil filter can be placed for its crushing, said cylinder apertured plate defining bottom wall of said crushing chamber.

19. The industrial apparatus of claim 18, wherein said crushing chamber three side walls, top wall, and said apertured plate are joined into a unibody structure.

20. The industrial apparatus of claim 19, wherein said walls and plate are welded together.

21. The industrial apparatus of claim 18, wherein the aperture on the chamber side of said apertured plate has an annual collar therearound and through which said rod extends.

22. The industrial apparatus of claim 18, wherein one of said side walls contains an aperture connected to a hose for conveying spent oil from said chamber to an oil receiving station.

23. The industrial apparatus of claim 18, wherein said chamber is fitted with an access door switch that is connected to a safety control circuit capable of turning off said apparatus when the chamber door is open and said ram is crushing a spent oil filter.

24. In an industrial apparatus having a motor energizable from a source to effect the reciprocal drive of a ram to and away from an initial lower station, said ram being mounted within a housing and having an access door movable from and into a closed orientation, the safety control circuit comprising:

(a) connector switch having an inductor and at least one normally open motor drive contact coupled for electrically energizing said motor, said inductor being electrically energizable from said source and located within an electrical network coupled in electrically parallel relationship with said motor;

(b) a normally open start switch actuable from an open to a closed condition to effect application of said source to energize said inductor so as to effect closure of said motor to effect commencement of movement of said ram assembly;

(c) a ram monitor switch having first and second contact components connected in mutually parallel relationship and in series relationship with said inductor and actuable to open and close said first and second contact components;

(d) a ram switch actuator movable in correspondence with said ram and effecting actuation of said ram monitor switch to close said first contact component and open said second contact when said ram plate is at said initial station, and actuating said ram monitor switch to open said first contact component and close said second contact component when said ram plate is moved from said initial station; and (f) an access door switch coupled in energization enabling relationship with an inductor and having an enabling condition when said access door is in said closed orientation permitting energization of said inductor and a disabling condition when said access door is in said open orientation disabling the energization of said inductor.

25. The safety control circuit of claim, 24 including:

a timer deriving a timed output a predetermined safety interval following its energization;

a timing switch coupled with said inductor, normally enabling the energization of said inductor and responsive to said timed output to effect the de-energization of said inductor;

said ram monitor switch includes a third contact component actuable between disabling and enabling conditions respectively to energize and de-energize said timer; and said ram switch actuator effects actuation of said ram monitor switch third contact component to said enabling condition when said ram is at said initial position.

26. The safety control circuit of claim 25, in which said timer is energizable from said source only in the presence of said closure of said motor drive contact.

27. The safety control circuit of claim 25, in which said ram switch actuator effects actuation of said ram monitor switch third contact component to said disabling condition when said ram plate is away from the initial position.

* * * * *